United States Patent [19]

Sugino et al.

[11] 4,196,609

[45] Apr. 8, 1980

[54] TUBE EXPANDER

[75] Inventors: Kenji Sugino, Uozu; Eitsugu Mori, Kurobe, both of Japan

[73] Assignee: Sugino Machine Limited, Uozu, Japan

[21] Appl. No.: 954,537

[22] Filed: Oct. 25, 1978

[30] Foreign Application Priority Data

Oct. 28, 1977 [JP] Japan ..... 52-129448

[51] Int. Cl.[2] ..... B21D 41/02

[52] U.S. Cl. ..... 72/122; 72/125; 29/727

[58] Field of Search ..... 72/112, 120, 122, 123, 72/124, 126; 29/727

[56] References Cited

U.S. PATENT DOCUMENTS

| | | | |
|---|---|---|---|
| 426,044 | 4/1890 | Murray | 72/122 |
| 1,235,835 | 8/1917 | Nilson | 72/122 |
| 1,601,329 | 9/1926 | Slesazeck | 72/123 |
| 3,221,528 | 12/1965 | Linthicum et al. | 72/122 |

*Primary Examiner*—Lowell A. Larson
*Attorney, Agent, or Firm*—Fleit & Jacobson

[57] ABSTRACT

Disclosed is a tube expander in which a mandrel itself is in the form of a short metal bar and the mandrel is fitted into a cage having loosely fitted therein a plurality of rollers adapted to perform a tube expanding function. The forward end of the mandrel includes a threaded portion formed in the outer surface thereof and engageable with a threaded guide disposed inside the forward end portion of the cage and adapted to be rotatable with the cage and slidable axially thereof, and the rear end of the mandrel is engaged with a mandrel drive which axially slidably rotates the mandrel. A suitable number of shanks may be added to the mandrel drive as occasions demand, whereby the desired tube expanding operation can be performed without the need to apply any propelling force to the mandrel drive but simply by externally applying a turning force to the mandrel drive or the shanks.

6 Claims, 5 Drawing Figures

TUBE EXPANDER

BACKGROUND OF THE INVENTION

In the past, it has been the usual practice to use a tube expander having a long overall tool length for performing the tube expanding operation at the baffle plates as well as the tube expanding operation at the thick wall tube plates in heat exchangers, condensers, etc. While the tube expanding operation will be effected satisfactorily if there is a sufficient space for installing the long tool, where there is provided the baffle chamber d as shown in FIG. 4 the available space L for tool installation is smaller than the overall length L of the long tool shown in FIG. 5 and consequently the installation of the tool is not possible. The occurrence of this case is relatively frequent and in such a case the tube expanding operation is effected by removing the baffle chamber and the chamber is reinstalled upon completion of the operation, thus deteriorating the efficiency of the tube expanding operation very greatly.

Where the baffle chamber has been welded making its removal impossible, after the assembling of a heat exchanger or condenser the expanded tube portions are subjected to reinforcing clamping, and in the event that there arises a need for a tube expanding operation it will be a frequent occurrence that the tube expanding operation is impossible thus making it inevitable to blank off the portion to be repaired by means of a blank or tube plug, thereby giving rise to a difficult problem of greatly decreasing the efficiency of the heat exchanger or the like.

Another disadvantage of the known tube expander is that since a propelling force must be externally imparted to the mandrel until the rollers bite into the tube, where the space is limited as mentioned previously it is not an easy matter to mount the required drive unit in position or perform the required tube expanding operation. Further, as shown in FIG. 5, the shown tube expander comprises a single mandrel 1 and a single cage 2, with the result that due to its structure the tube expander cannot be separated into the mandrel 1 and the cage 2 so as to be assembled at the time of use or operation, and after all the device inevitably results in a long tube expander.

SUMMARY OF THE INVENTION

The present invention has been created to overcome the foregoing deficiencies in the prior art, and the invention comprises a tube expander comprising a cylindrical cage having at its forward end a resisting member against the inner surface of a tube and a plurality of rollers having a tube expanding function and loosely fitted in the outer surface of its intermediate portions at predetermined positions, a threaded guide fitted inside the cage forward end portion so as to be rotatable with the cage and slidable axially of the cage, a mandrel mounted inside the cage and formed in the outer surface of its forward end with threads which are engageable with the threaded guide, the mandrel further including a sloped portion following the forward end and gradually increasing in diameter toward the rear end of the mandrel, and a mandrel drive coupled to the rear end of the mandrel so as to axially slidably rotate the mandrel. In accordance with another form of the invention, one or more shanks which are addible to each other are removably attached to the rear end of the mandrel drive.

It is therefore a first object of the present invention to provide a tube expander whose length is adjustable and which is adapted to be easily and efficiently installed in place no matter how the tool installation space is limited and capable of easily and accurately expanding long tubes of any kinds.

It is a second object of the invention to provide a tube expander which is capable of performing the desired tube expanding operation without the need to apply any propelling force but by simply applying externally a turning force to the mandrel drive or the shanks.

These and other objects, features and advantages of the present invention will become more apparent from the following description.

DESCRIPTION OF THE PREFERRED EMBODIMENTS

The present invention comprises a tube expander including a mandrel having a tapered central portion, a plurality of rollers arranged at predetermined angular intervals to enclose the mandrel and a cylindrical cage adapted to hold the rollers at the predetermined angular intervals, wherein the tube expander proper is reduced in length, a mandrel drive is coupled to the rear end of the mandrel and the mandrel drive is adapted so that a suitable number of shanks can be added to the mandrel drive to suit the use conditions at a site, whereby any long tubes can be expanded in any limited space and the desired tube expanding operation can be accomplished without the need to apply any propelling force but by simply applying externally a turning force to the mandrel drive or the shank.

Figure 1:
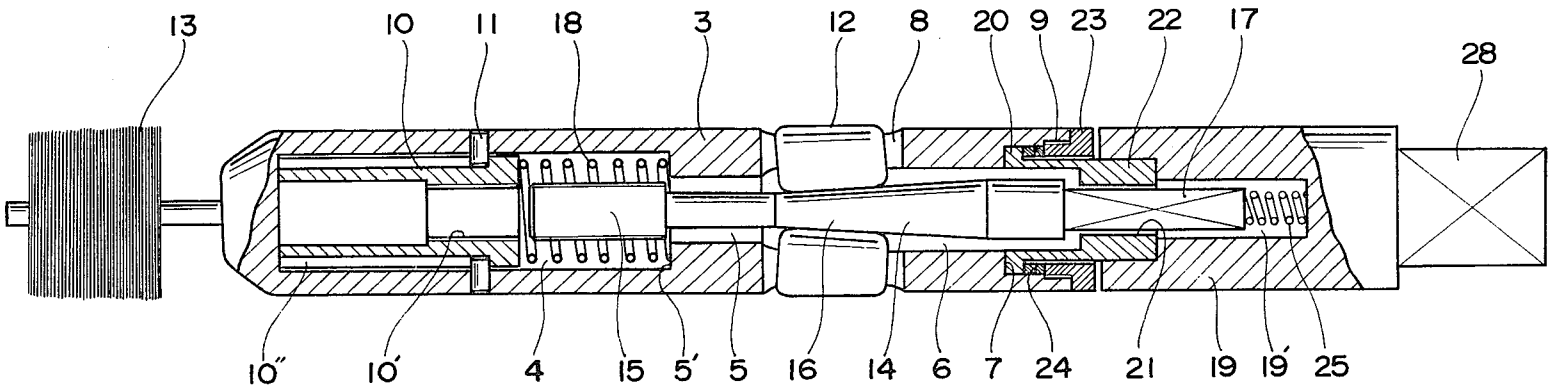
FIG. 1 is a schematic longitudinal sectional side view showning an embodiment of a tube expander according to the invention.
Figure 2:
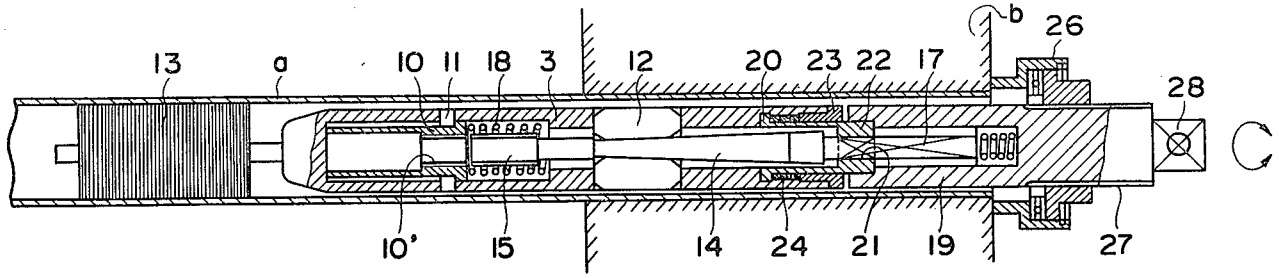
FIG. 2 is a longitudinal sectional side view showing the manner in which the tube expander of the invention is inserted into the tube hole.
Figure 3:
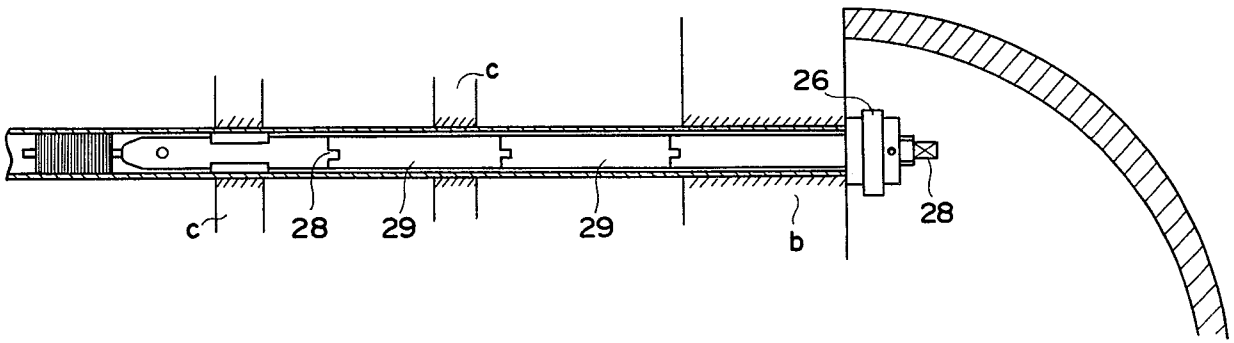
FIG. 3 is a longitudinal sectional side view showing schematically the manner in which shanks are added to the tube expander to provide a long tube expander.
Figure 5:
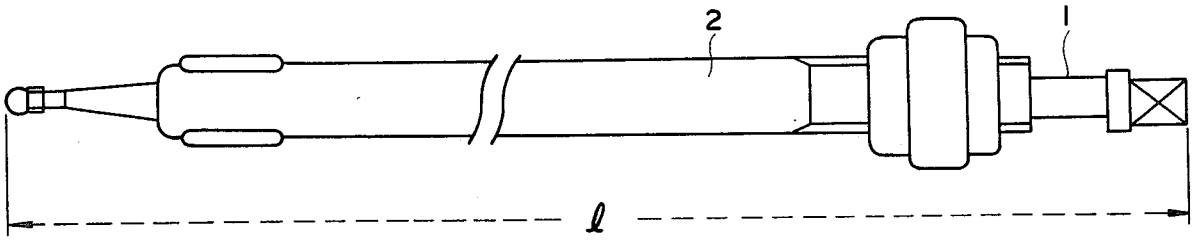
FIG. 5 is a side view of a prior art tube expander.
Figure 4:
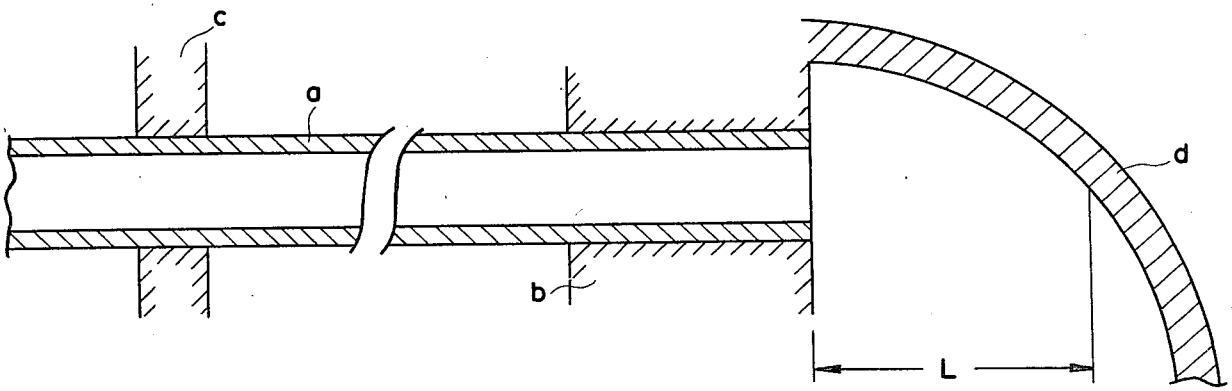
FIG. 4 is a partial longitudinal sectional side view showing an exemplary heat exchanger including a baffle chamber.

Referring to FIGS. 1 to 3, numeral 3 designates a cylindrical cage formed therein with a large-diameter hollow portion 4, a small-diameter hollow portion 5, a medium-diameter hollow portion 6 and a large-diamter hollow portion 7 arranged from the forward end in this order and connected with one another, and a roller loose fitting portion 8 is provided at a predetermined position in the outer surface of the forward end of the medium-diameter hollow portion 6 so as to hold three to six rollers (4 rollers in the illustrated embodiment) at predetermined angular intervals. Numeral 9 designates a threaded bush mounting thread portion formed in the rear end inner surface of the cage 3.

Numeral 10 designates a cylindrical threaded guide adapted to be fitted in the forward end of the large-diameter hollow portion 4 of the cage 3 and formed with threads 10′ in its inner surface and a plurality of guide grooves 10″ arranged in the outer surface at predetermined spaces to extend axially. The cage 3 is provided with a plurality of locking pins 11 which are each fitted in corresponding one of the guide grooves 10'' and consequently the threaded guide 10 is rotatable with the cage 3 and also slidable axially of the cage 3.

Numeral 12 designates tube expanding rollers loosely fitted in the roller loose fitting portion 8 of the cage 3, and 13 a resisting member against the tube inner wall consisting for example of a brush made of polyamide and fixedly mounted to the forward end of the cage 3.

Numeral 14 designates a mandrel mounted inside the cage 3 so as to be slidable back and forth, and the mandrel 14 includes threads 15 formed in the outer surface of its end located in the rear end portion of the large-diameter hollow portion 4 to engage with the threads 10', a tapered surface 16 formed in the outer surface of its central portion and gradually increased in the diameter toward the rear end of the mandrel and a square portion provided at its rearmost end for engagement with a mandrel drive. Numeral 18 designates a spring mounted around the threaded end portion 15 of the mandrel 14 and having one end abutted against a forward end outer side face 5' of the small-diameter hollow portion 5 and the other end resiliently pressed against the threaded guide 10 to always urge it toward the cage forward end.

Numeral 19 designates a cylindrical mandrel drive including a hollow portion 19' into which the mandrel rear end square portion 17 is slidably fitted, and fixedly mounted in the opening at the forward end of the mandrel drive 19 is a cylindrical socket 22 including a flange portion 20 provided at its forward end so as to be fitted in the mandrel large-diameter hollow portion 7 and a square socket portion 21 provided in its rear end inner surface for engagement with the mandrel rear end square portion 17, whereby the forward end of the socket 22 is engaged with the rear end inner surface of the cage 3 and the rear end face of the flange portion 20 is connected through a thrust ring 24 to a bush 23 threadedly fitted in the rear end of the cage 3. Mounted inside the mandrel drive 19 is a spring 25 having its one end abutted against the bottom of the mandrel drive 19 and its other end resiliently pressed against the mandrel square portion 17, thus locking and holding the mandrel 14 in a predetermined position in the cage 3.

Numeral 26 designates a bearing collar which is axially movably and removably threadedly mounted on a threaded portion 27 formed in the rear end outer surface of the mandrel drive 19, and the bearing collar 26 serves the functions of reducing the thrust load on the self-propelling force of the tool which is produced during the positioning of the mandrel in the tube expanding position and the tube expanding operation and ensuring smooth rotation of the tool.

Numeral 28 designates a square shank portion formed on the rear end of the mandrel drive 19, whereby when occasions demand, as shown in FIG. 3, the square socket of a shank 29 is fitted on the shank portion 28, and the mandrel drive 19 and the shank 29 or the shanks 29 are connected with one another by means of set-screws which are not shown. Symbol a designates a tube which is to be expanded into a tube plate b or a baffle plate c.

The function and effect of the tube expander according to the invention will now be described. In operation, the brush 13 is first inserted into the tube a and a suitable number of the shanks 29 are added until the rollers 12 reach a desired tube expanding portion, and the bearing collar 26 is mounted on the rear end of the terminal shank 29 to establish the tube expanding position.

The terminal shank is then connected to a known type of tube expansion controlling drive unit which is not shown and the shank is rotated clockwise by this drive unit.

This rotation rotates the mandrel 14 through the shanks 29, 29, - - -, the mandrel drive 19 and the socket 22 fitted in the mandrel drive 19.

When the mandrel 14 is rotated, the cage 3 also tends to rotate due to the frictional relation between the mandrel 14 and the rollers 12 or between the socket 22 and the rear end inner surface of the cage 3. In this case, however, the rotational speed of the cage 3 is reduced due to the contact resistance between the brush 13 at the forward end of the cage 3 and the tube a.

Consequently, there results a peripheral speed difference between the rotational speeds of the cage 3 and the mandrel 14, so that the threaded portion 15 at the forward end of the mandrel 14 is screwed into the threaded portion 10' of the threaded guide 10 and the mandrel 14 is propelled or moved by itself.

By virtue of the self-movement of the mandrel 14, its sloped gradually increasing large-diameter portion is gradually brought into contact with the rollers 12 held in place in the cage 3 so that the rollers 12 supported by the cage 3 are radially projected from the cage 3 and consequently the rollers 12 are rotated in contact with the inner surface of the tube a.

When the rollers 12 are rotated in contact with the inner surface of the tube a, due to the feed angle provided by inclining the axes of the rollers 12 and the mandrel 14 with respect to each other, the mandrel 14 is moved forward by its own force. This relation is the same with the relation between the mandrel and the rolls in the ordinary tube expander.

Consequently, the tube a is expanded by the rollers 12 in response to the self-movement of the mandrel 14, and the mandrel 14 is fed until the tube a is expanded to the desired amount.

When the tube is expanded to the extent that the tool diameter attains the maximum value, the threaded portion 15 of the mandrel 14 comes out of engagement with the threaded portion 10' of the guide 10 and consequently the mandrel 14 rotates idly. Thus, the tube a is no longer expanded.

When the desired tube expansion is completed, the shanks 29 are now rotated counterclockwise, so that by virture of the self-movement of the mandrel 14 or the rollers 12 in the reverse direction, the mandrel 14 is moved backward and the rollers 12 are retracted into the cage 3, thus reducing the tool diameter to the minimum and disengaging the threaded portion 15 of the mandrel 14 with the threaded portion 10' of the guide 10 and thereby causing it to rotate idly.

The tool is then withdrawn from the tube and the next tube expanding operation is inititated. The prior art tube expander comprises a single mandrel and a single cage and consequently structurally it is impossible to disassembly and reassembly the expander to suit the conditions at a site, nor is it possible to extend the mandrel and the cage to increase the length of the expander to suit the site conditions.

The tube expander of this invention has among its great advantages the fact that the mandrel is mounted inside the cage for self-movement and consequently it is only necessary to apply a turning force to the mandrel, thus making it possible to add a suitable number of shanks to the mandrel drive coupled to the rear end of the mandrel as occasions demand to suit the conditions of a site and any long tube to be expanded, making it possible to install the expander in any limited space to effect the desired tube expanding operation and only requiring to externally apply a turning force to the mandrel and thereby greatly simplifying the operation.

We claim:

1. A tube expander insertable into a tube to be expanded and comprising:

a cylindrical cage including resisting means mounted to a forward end thereof for contacting an inner wall of a tube and resisting rotational movement of the cage with respect to the wall and a plurality of rollers each having a tube expanding function and loosely fitted in an outer surface of an intermediate portion of said cage at a predetermined position;

a threaded guide formed with threads in the inner surface thereof and mounted inside the forward end of said cage for rotation therewith and so as to be slidable axially;

a mandrel mounted inside said cage, said mandrel including a threaded portion formed in the outer surface of the forward end thereof for engagement with said threaded portion of said guide, and a tapered portion connected to said forward threaded portion and having a diameter gradually increased toward the rear end of said mandrel; and a mandrel drive engaged with the rear end of said mandrel to impart thereto an axially slidable rotary motion.

2. A tube expander insertable into a tube to be expanded and comprising:

a cylindrical cage including resisting means mounted to a forward end thereof for contacting an inner wall of a tube and resisting rotational movement of the cage with respect to the tube and a plurality of rollers each having a tube expanding function and loosely fitted in an outer surface of an intermediate portion of said cage at a predetermined position;

a threaded guide formed with threads in the inner surface thereof and mounted inside the forward end of said cage for rotation therewith and so as to be slidable axially;

a mandrel mounted inside said cage, said mandrel including a threaded portion formed in the outer surface of the forward end thereof for engagement with said threaded portion of said guide, and a tapered portion connected to said threaded portion and having a diameter gradually increased toward the rear end of said mandrel;

a mandrel drive engaged with the rear end of said mandrel to impart thereto an axially slidable rotary motion; and at least one shank adapted to be successively removably connected to a rear end of said mandrel drive.

3. A tube expander according to claims 1 or 2, wherein said mandrel includes a square portion provided at the rear end thereof, and wherein said mandrel drive includes a socket provided at the forward end thereof, said socket having a square socket portion formed in the inner surface thereof, whereby said square portion is fitted in said square socket portion so as to be slidable in the axial direction of said mandrel.

4. A tube expander according to claim 3, wherein said mandrel drive includes a square shank portion provided at the rear end thereof, and wherein a locating bearing collar is mounted on the outer surface of the rear end of said mandrel drive so as to be movable axially of said mandrel.

5. A tube expander according to claim 4, wherein said mandrel drive is connected to the rear end of said cage by way of said socket.

6. A tube expander according to claim 2, wherein said shank is provided at its one end with a square socket and at its other end with a square shank portion.

* * * * *